United States Patent [19]

Bullard, Jr.

[11] Patent Number: 4,968,061

[45] Date of Patent: Nov. 6, 1990

[54] MAGAZINE ADVERTISING DEVICE

[76] Inventor: Raymond C. Bullard, Jr., 252 Henry St., Fairfield, Conn. 06430

[21] Appl. No.: 431,768

[22] Filed: Nov. 6, 1989

[51] Int. Cl.[5] ..... B42D 5/00

[52] U.S. Cl. ..... 281/15.1; 281/29; 281/36; 281/31; 281/2; 281/5

[58] Field of Search ..... 281/2, 5, 31, 15.1, 281/29, 36; 283/56; 206/462

[56] References Cited

U.S. PATENT DOCUMENTS

| | | | |
|---|---|---|---|
| 1,689,637 | 10/1928 | Mordecai | 281/15.1 |
| 1,714,774 | 5/1929 | Goldsmith | 206/475 |
| 2,071,735 | 2/1937 | Downey | 206/82 |
| 3,256,634 | 6/1966 | Mace | 46/11 |
| 3,455,575 | 7/1969 | Seidman | 283/56 |
| 4,176,473 | 12/1979 | Rae | 35/35 E |
| 4,307,897 | 12/1981 | Sarkans et al. | 281/15.1 |
| 4,492,306 | 1/1985 | Cooper et al. | 206/216 |
| 4,598,934 | 7/1986 | Cashel | 281/2 |
| 4,819,962 | 4/1989 | Takai | 281/15.1 |
| 4,824,143 | 4/1989 | Grainger | 281/15.1 |
| 4,831,756 | 5/1989 | Huang et al. | 281/31 |
| 4,890,872 | 1/1990 | Parrotta et al. | 283/56 |

*Primary Examiner*—Douglas D. Watts
*Assistant Examiner*—Thomas Hamill, Jr.
*Attorney, Agent, or Firm*—Kramer, Brufsky & Cifelli

[57] ABSTRACT

A method and device for advertising goods which includes a booklet having front and back cover sections and a plurality of pages therebetween adapted to bear descriptive material. A plurality of slots partially extend through the pages. Each of the slots is adapted to receive a sample of goods being advertised.

13 Claims, 1 Drawing Sheet

MAGAZINE ADVERTISING DEVICE

While the subject application is adapted for a wide range of applications, it is particularly suitable for use as an advertising device and in particular, for incorporating in a magazine or pamphlet samples or specimens of the goods being advertised therein.

In advertising various goods, it is heretofore been the practice to distribute literature relating thereto in magazines, while simultaneously enclosing samples of the goods described in the advertisements. Although an occasional single flat sample has been included in a magazine, it has been impractical to include a plurality of specimens of the goods being advertised and, in particular, those that are of a shape which would inherently prevent the magazine from lying flat when closed.

A number of patents directed to advertising goods have been known in the prior art. For example, U.S. Pat. No. 1,689,637 to Mordecai discloses a pamphlet of any desired size which comprises front and back sections disposed on either side of a pad of leaves. An aperture formed through the front cover section and each of the leaves frames a package which is carried on the back cover section of the pamphlet. The patent to Mordecai can be distinguished from the present invention where slots are cut into the pages of a booklet at different depths for receiving samples of goods being advertised within the booklet.

Another conventional advertising scheme is disclosed in U.S. Pat. No. 4,176,473 to Rae. This patent discloses a multi-page book containing three-dimensional removable figures within the individual pages. The disclosure is quite different from the present invention because it does not include slots which extend to different depths within the pages of the book.

Another conventional advertising device is disclosed in U.S. Pat. No. 4,492,306 to Cooper et al. In this patent, a removable pouch is bound into the spine of a magazine. Clearly, this concept is significantly different from the provision of slots receiving samples of goods as disclosed in the present invention.

Other schemes for incorporating objects in books or pamphlets are disclosed in U.S. Pat. Nos. 1,714,774, 2,071,735 and 3,256,634.

It is a problem underlying the present invention to provide a method and device for advertising goods in a booklet wherein specimens of the goods can be carried within slots formed in the pages of the magazine.

It is an advantage of the present invention to provide a method and device for advertising goods in a booklet which obviates one or more of the limitation and disadvantages of the described prior arrangements.

It is a further advantage of the present invention to provide a method and device for advertising goods in a booklet wherein a plurality of samples of the goods can be carried within the booklet.

It is a still further advantage of the present invention to provide a method and device for advertising goods in a booklet which is relatively inexpensive to manufacture.

Accordingly, there has been provided a method and device for advertising goods including a booklet having front and back cover sections and a plurality of leaves therebetween adapted to bear descriptive material. A plurality of slots partially extend through the leaves. Each of the slots is adapted to receive a sample of goods being advertised.

BRIEF DESCRIPTION OF THE DRAWINGS

The invention and further developments of the invention are now elucidated by means of preferred embodiments shown in the drawings.

DETAILED DESCRIPTION OF THE PREFERRED EMBODIMENT

Figure 1:
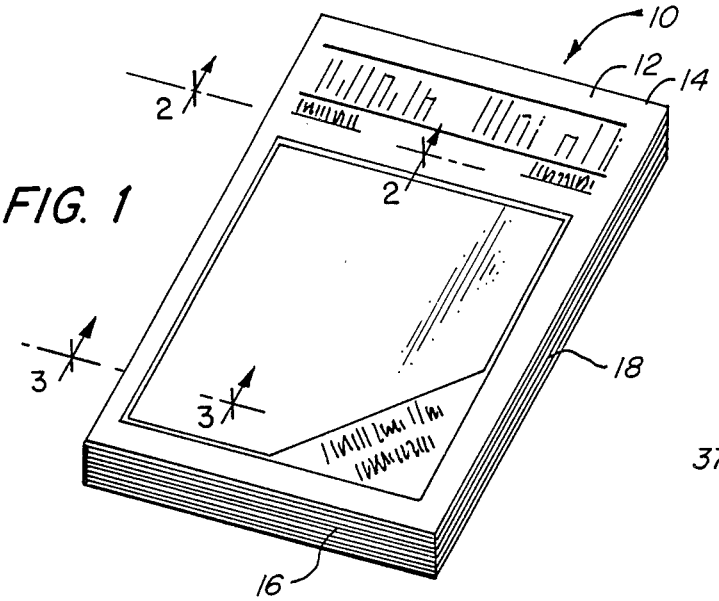
FIG. 1 is a diagrammatical view of a magazine incorporating the present invention.

A method and device 10 for advertising goods is illustrated in FIGS. 1 through 4. The device includes a booklet 12 having front and back cover sections 14 and 16, respectively, and a plurality of pages or leaves 18 adapted to bear descriptive material therebetween. A plurality of slots 20 partially extend through the pages 18. Each of the slots is adapted to receive a sample 22 of goods being advertised.

Referring again to FIGS. 1 through 4, there is shown the device 10 for advertising goods. The device can be used in many contexts. However, for the purpose of the present invention, a booklet 12 is described. The term booklet is used to describe a broad category of advertising media including magazines, books, catalogs, pamphlets, newspapers and the like.

The booklet includes a front cover section 14 which is preferably bound to a back cover section 16. Typically, the front and back cover sections are constructed of a heavier material than that which is used for the plurality of pages 18. Typically, the front and back cover sections are bound together by a spine 24 with the pages 18 bound inbetween thereof. However, it is within the terms of the present invention for the front and back cover sections to be constructed of a material having any desired weight.

Figure 2:
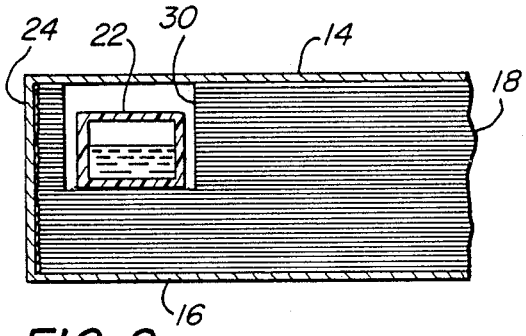
FIG. 2 is a view through 2—2 of FIG. 1.
Figure 3:
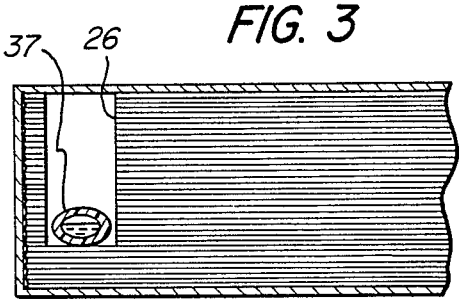
FIG. 3 is a view through 3—3 of FIG. 1.
Figure 4:
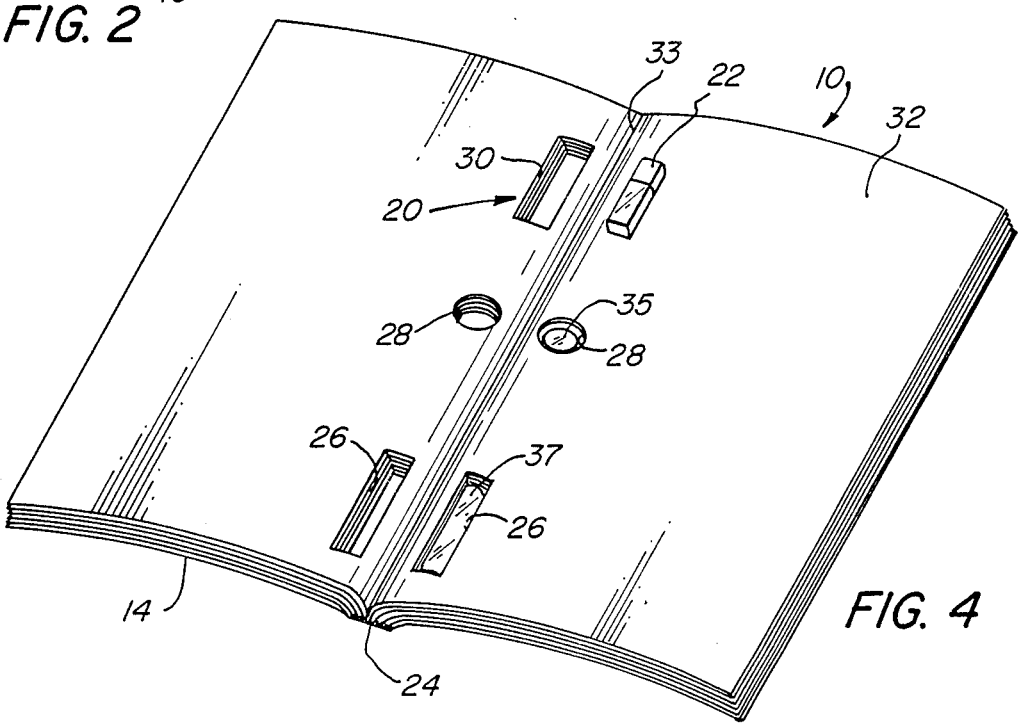
FIG. 4 is a diagrammatical view of an open magazine showing a plurality of slots in accordance with the present invention.

The slots 20 can be formed at any location on the pages 18 and are of any required size to receive a sample 22, 35, 37 of the desired goods. As shown in FIGS. 2 through 4, any appropriate shaped slot can be used to accommodate the sample. The term sample can refer to the goods themselves or packaging containing the goods.

The individual slots 26, 28, and 30 are illustrated as being cut into the pages 18 beginning from the first page closest to the cover section 14. However, the slots can begin and end between any selected segment of pages. The depth of each slot can extend down to the specific page containing a description or advertisement of the goods represented by the sample placed within that specific slot. However, it is within the terms of the present invention to place the page containing the advertisement on any page or cover within the booklet.

As shown in FIGS. 2 and 3, slots 26 and 30 can be of different depths. For example, slot 30 might contain a sample such as a small vial 22 of perfume. This perfume can be advertised on a designated page 32. Slot 28 can contain a sample 35 and slot 26 can contain a sample 37. Typically, the sample, such as a vial 22 of perfume, can be attached to a page by any desired means such as an adhesive strip. It is, however, also within the terms of the present invention to hold the sample within the slots by a friction rather than directly attaching the vial to the specific page on which it is advertised.

The position of the slots 20 are preferably along the inner border of the pages as depicted in FIG. 4. By positioning the slots close to the inner edge, as represented by reference numeral 33, there is less likelihood that they will interfere with the material on the pages through which the slots are formed. However, it is within the terms of the present invention to place the slots in any desired location on the pages.

Typically, the slots will only be formed in the plurality of pages 18. This is advantageous because the pamphlet can be more attractive if its front and back covers are free from the slots. However, it is within the terms of the present invention to form the slots through the front and/or rear covers.

Figure 3A:
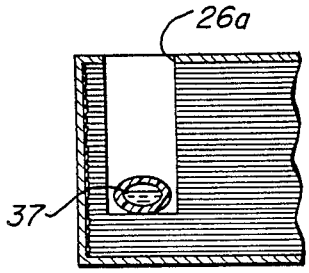
FIG. 3A shows an alternative embodiment of the magazine of the present invention wherein slots 26*a* extend through the front cover section of the magazine.

FIG. 3A illustrates an alternative embodiment of the invention wherein the slot **26*a* extends through the front cover of the booklet and partially through the pages 18**.

The patents set forth in this application are intended to be incorporated by reference herein.

It is apparent that there has been provided in accordance with the present invention a method and device for advertising goods which satisfies the objects, means, and advantages set forth hereinabove. While the invention has been described in combination with the embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A device for advertising goods, comprising:

a booklet having front and back cover sections and a plurality of pages adapted to bear descriptive material therebetween, said pages providing a depth to said booklet between said front and back cover sections and a plurality of slots partially extending through the depth provided by said pages, each of said slots being of a shape to accommodate a sample of goods being advertised.

2. The advertising device of claim 1 wherein said plurality of pages are secured between the front and back cover section.

3. The advertising device of claim 2 wherein the slots are disposed adjacent an edge of the booklet where the front and back cover sections are secured to the plurality of pages.

4. The advertising device of claim 2 wherein each of said slots begins on a selected page, partially extends through the depth of said booklet and terminates on a page describing a sample goods being advertised.

5. The advertising device of claim 4 further comprising samples of goods wherein the samples of goods are secured to the pages on which the goods are advertised, said samples being detachable from said pages.

6. The advertising device of claim 3 wherein the slots extend through the front cover section of the booklet.

7. The advertising device of claim 6 wherein the sample of goods are contained in the slots shaped to accommodate said goods so that the samples can be viewed within the slots formed in the plurality of pages.

8. A method of advertising goods comprising the steps of:

providing a booklet having front and back cover sections and a plurality of pages adapted to bear descriptive material therebetween, said pages providing a depth to said booklet between said front and back cover sections; and forming a plurality of slots to partially extend through the depth provided by said pages, each of said slots being of a shape to accommodate a sample of goods being advertised.

9. The method of advertising goods of claim 8 including the step of placing the sample of goods in each of the slots.

10. The method of advertising goods of claim 9 including the step of terminating each of said slots at the page which describes the sample of goods adapted to be contained therein.

11. The process of advertising goods of claim 10 including the step of detachably securing the samples to the page on which the specific goods are described.

12. The advertising device of claim 2 wherein the said slots extend to different depths within the plurality of pages of said booklet.

13. The advertising device of claim 2 wherein each of the said slots are of a different shape.

* * * * *